US006715955B2

(12) United States Patent
Ginzel

(10) Patent No.: US 6,715,955 B2
(45) **Date of Patent: *Apr. 6, 2004**

(54) ATTACHMENT DEVICE FOR MOUNTING A PAIR OF GLASS PANES FIXEDLY TO A STRUCTURE, SUCH AS A BUILDING

(75) Inventor: Lothar Ginzel, Schwerte (DE)

(73) Assignee: Dorma GmbH + Co. KG, Ennepetal (DE)

( * ) Notice: Subject to any disclaimer, the term of this patent is extended or adjusted under 35 U.S.C. 154(b) by 0 days.

This patent is subject to a terminal disclaimer.

(21) Appl. No.: 09/838,349

(22) Filed: Apr. 19, 2001

(65) Prior Publication Data

US 2002/0031398 A1 Mar. 14, 2002

Related U.S. Application Data

(63) Continuation-in-part of application No. PCT/EP00/08080, filed on Aug. 18, 2000.

(30) Foreign Application Priority Data

Aug. 20, 1999 (DE) ..... 199 39 172

(51) Int. Cl.[7] ..... E04B 2/90

(52) U.S. Cl. ..... 403/388; 52/204.593; 52/204.591; 403/384

(58) Field of Search ..... 52/204.591, 204.593, 52/782.1, 783.1, 786.1, 506.01; 403/270, 21, 291, 384, 388, 389

(56) References Cited

U.S. PATENT DOCUMENTS 5,540,514 A * 7/1996 Demars et al. ..... 403/122
6,105,319 A * 8/2000 Brunt ..... 52/204.593
6,115,989 A * 9/2000 Boone et al. ..... 52/204.61
6,254,397 B1 * 7/2001 Elmer ..... 439/6

FOREIGN PATENT DOCUMENTS

| | | | | |
|---|---|---|---|---|
| DE | 3612681 A1 * | 7/1987 | ..... | E06B/3/66 |
| DE | 9318862 | 5/1995 | | |
| DE | 4400979 | 7/1995 | | |
| DE | 4445724 | 6/1996 | | |
| DE | 19519527 A1 * | 11/1996 | ..... | E04B/2/88 |
| DE | 29602315 | 8/1997 | | |
| EP | 0707153 | 4/1996 | | |
| EP | 0784129 | 7/1997 | | |

* cited by examiner

*Primary Examiner*—Lynne H. Browne
*Assistant Examiner*—Ryan M. Flandro
(74) *Attorney, Agent, or Firm*—Nils H. Ljungman & Associates

(57) ABSTRACT

This invention relates to a fastening device for an insulating glass panel. A punctiform holder (1) is used that is fastened by means of an adhesive (51) to the outside of the insulating glass plate (50). In the vicinity of the punctiform holder (1), a spacer piece (53) is inserted between the separated glass plates (2, 50). The invention further relates to a mounting element (5) with adjustable bias, whereby between a cap bell (10) and the mounting element (5) there is a permanently elastic spring element (7) that permits a relative movement of the cap bell (10) with respect to the mounting element (5). The invention further relates to the realization of a plurality of three-dimensional articulations (12, 13) between the insulating glass plate (2, 50) and the holder on the building side.

12 Claims, 8 Drawing Sheets

FIG. 3
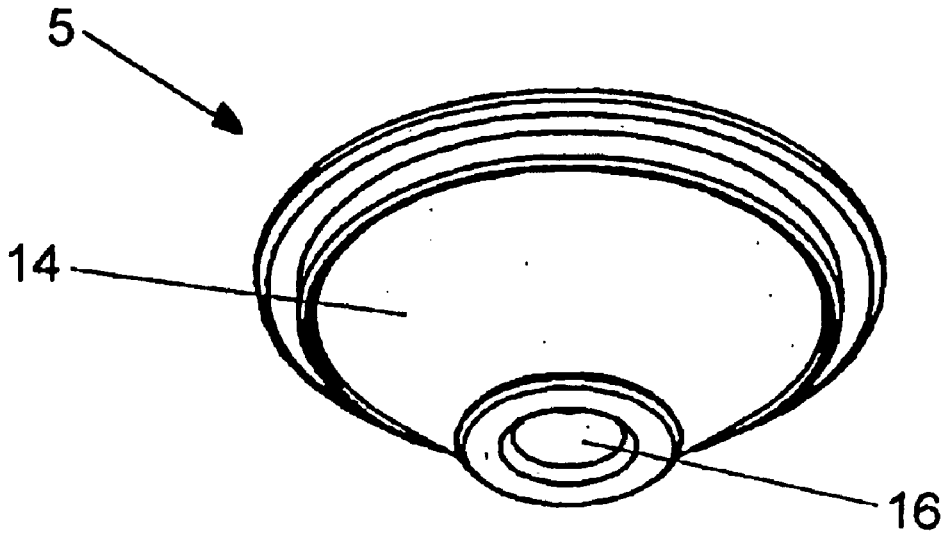
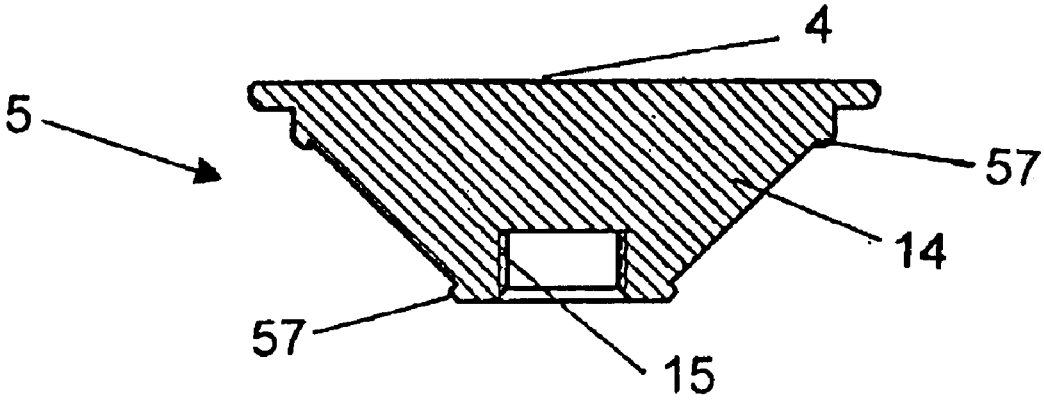
FIG. 4

ATTACHMENT DEVICE FOR MOUNTING A PAIR OF GLASS PANES FIXEDLY TO A STRUCTURE, SUCH AS A BUILDING

CONTINUING APPLICATION DATA

This application is a Continuation-In-Part application of International Patent Application No. PCT/EP00/08080, filed on Aug. 18, 2000, which claims priority from Federal Republic of Germany Patent Application No. 199 39 172.6, filed on Aug. 20, 1999. International Patent Application No. PCT/EP00/08080 was pending as of the filing date of this application. The United States was an elected state in International Patent Application No. PCT/EP00/08080.

BACKGROUND OF THE INVENTION

1. Field of the Invention

The invention relates to an attachment device for mounting a glass pane fixedly at a structure, such as a building.

The invention also relates to a facade with attachment devices for mounting glass panes fixedly to a structure, such as a building.

This invention further relates to a punctiform holder (a holder having the form of a point), or an attachment device, to connect insulating glass panels that is used to connect at least two glass plates that are separated from each other by an air gap that is preferably filled with a gaseous medium, whereby the punctiform holder is detachably or non-detachably connected to a substructure.

2. Background of the Invention

A holder of this type that can be used as a punctiform holder that is free of bending moments for multiple-pane insulating glass panels is disclosed in German Utility Model 93 18 862. In that case, the punctiform holder is penetrated by borings that are inside the separated glass plates. For this purpose it is necessary, in the vicinity of the borings inside the separated glass plates, to hermetically seal the glass plates with respect to the closed air space that surrounds them. Simultaneously, these separating devices between the two glass plates are also required to withstand or provide the force of the connection of the insulating glass plates by the punctiform holder. Thus, on the one hand, one contact plate is in contact with the outer area of the separated glass plates, and, on the other hand, another contact plate is in contact with the inner area of the separated glass plates, which are pulled toward each other by means of a screw element. In the vicinity of the connection of the punctiform holder, the holder is equipped with a ball and thus is movable within the complementary surfaces of the inner plate such that a rotation of the holder unit with respect to the substructure is possible. It is thereby possible to partly compensate for corresponding construction tolerances. Because this punctiform holder, on otherwise conventional single-pane glass panels, extends through the separated glass plates, it is very complex, expensive and critical to ensure the long-term stability of the connection. In addition to the borings that have to be introduced, it is also important to permanently and securely seal the air gap between the separated plates.

German Patent 44 00 979 A1 also discloses a similar device on which the clamp element or locating bearing on the inside of the building has, on its shell surface facing the holder, a crown-shaped surface, against which a compensating part with a complementary universal ball joint with a crown-shaped surface is in contact. The clamping element has a boring that runs all the way through the clamping element to hold the clamp bolt that connects the clamp elements, and a retaining bolt that runs through a spacer washer and the compensating part and is screwed into the clamp element. With the device of the prior art, construction tolerances between the boring in the glass panel and the substructure (holder) can be compensated, but there is no flexible elastic support of the plate on the holder after the glass plate has been installed.

German Patent 44 45 724 A1 describes a similar device in which the clamp element on the inside of the building has, on its shell surface facing the mounting, a crowned surface, with which the complementary surface of a pivot bearing of a fastening part is in contact, whereby the pivot bearing is held with some lateral play in a cap nut. Here, too, after installation, no relative movement between the plate and the fastening part is possible.

European Patent 0 784 129 A1 further describes a support of a fastening bolt on a holder on which a plate of the holder is fixed between two plano-convex lenses that are in indirect contact, via their plane surfaces, with the plate, whereby one lens is in contact with its convex surface on a clamp element on the inside of the building and the other lens is in indirect contact with a nut that receives the fastening bolt.

OBJECT OF THE INVENTION

The object of the invention is to simplify the prior art as described above to create a punctiform holder that can be manufactured economically for insulating glass panels. At the same time, the punctiform holder has a mounting that is essentially free of bending moments with a simultaneous compensation of tolerances with respect to the substructure.

Another object of the invention is to create a punctiform holder that can be manufactured economically for insulating glass panels, for example, glass panels to be utilized in a glass facade of a building.

SUMMARY OF THE INVENTION

The invention teaches that this object can be accomplished by a punctiform holder to connect insulating glass panels with at least two glass plates separated by an air gap that is preferably filled with a gaseous medium, and whereby the punctiform holder is also detachably or non-detachably connected to a substructure, characterized by the fact that the punctiform holder has a mounting element with a flat mounting surface which is detachably or non-detachably connected with an outside surface of the glass plates by adhesive and, in the air gap, in the vicinity of the punctiform holder, a spacer piece between the glass plates is also detachably or non-detachably connected with the glass plates by an adhesive. Further features of the invention are described herein.

The invention teaches that the borings that are conventionally present in the glass plates are omitted, and the detachable or non-detachable connection of the punctiform holder, which has a flat mounting surface, to one of the separated insulating glass plates, is formed by means of an adhesive. So that the weight of the insulating glass panel can also be supported securely by the punctiform holder even when there are two separated glass plates, in the air gap between the separated glass plates there is a spacer piece which is also detachably or non-detachably connected with the glass plates by an adhesive. This spacer piece can thereby be made of glass or metal. The adhesive used must be essentially UV-stable and preferably transparent. It must also have long-term creep stability with regard to the load-bearing characteristics. The proposed holder is also constructed so that it mounts the glass plates on a substructure in a manner that is free of bending moments. This concept also applies to the adhesive connection between the proposed holder and the insulating glass panel. The holder is therefore constructed so that it has an inside clamp element on its mounting surface that faces away from the glass plate in the form of a crown-shaped or curved surface formed by a permanently elastic flexible element, against which a complementary surface of an inner shell surface of a cap bell or coupling bell and a fastening bolt or attachment bolt can be placed in contact with an adjustable bias, whereby between the cap bell and the fastening bolt on one hand and the fastening bolt and the mounting on the other hand there are respective three-dimensional articulations that can be made rigid.

The invention teaches that wind pressure and thermal stresses are absorbed by the elastic support of the cap bell on the inside clamp element so that, even after installation, a relative movement of the two parts with respect to each other is possible without the introduction of restoring forces in the separated glass plates.

This capability is virtually guaranteed by the adjustable bias between the clamp element and the cap bell. As a result of the multiple subdivision of the fastening device by means of at least two additional three-dimensional articulations, not only is there an ability to compensate for rather large construction tolerances, but the individual articulation points of the three-dimensional articulations also form, even when they are rigidly clamped in place after installation, to a certain extent, junction points with a certain inherent elasticity which also contribute to the stress-free mounting of the glass plates.

In one embodiment of the invention, the inside clamp element itself can have a conical or crown-shaped surface on its shell facing away from the glass plate. Theoretically, the conical or crown-shaped surface can also be formed by the permanently elastic spring element even if the clamp element is flat. Furthermore, in the inside clamp element there can be a boring that connects the inside clamp element with the cap bell set screw, whereby, in one configuration of the invention, the permanently elastic spring element is realized in the form of a permanently elastic pad which is located between the conical or crown-shaped surface of an inside clamp element facing the mounting plate and the complementary surface of the cap bell. By means of the cap bell set screw described above, the permanently elastic pad can be biased so that not only can the stresses introduced in the glass plates be absorbed by the permanently elastic pad itself, but also a relative displacement of the cap bell, with respect to the permanently elastic pad, is possible, so that the glass plates and thus also the connection between the glass plates and the nut remain virtually completely stress-free.

One special characteristic of the invention is that the cap bell, on its side facing the holder, has a cylindrical extension that is provided with a male or external thread between which and the cap bell, in the vicinity of the bottom of the cap bell, there is an inwardly directed flange to support the bolt head of the cap bell set screw. The resulting play between the flange and a shank of the cap bell set screw thereby makes it possible to locate a washer that is realized in the form of a lens between the flange and the screw head of the cap bell set screw, so that the shank of the cap bell set screw can exert an oscillating or reciprocating movement with respect to the cap bell. This oscillating movement is facilitated if the contact surface of the flange and the matching surface of the lens are realized with a conical or crown shape. For this purpose, it has been found to be appropriate to use a non-metallic lens, for example, one that is made of a hard rubber that has a sliding capability. In this manner, an additional three-dimensional articulation can be practically created between the cap bell and the inside clamp element and thus the glass plates.

An additional three-dimensional articulation results from the fact that the end surface of the extension of the cap bell that points toward the holder can be curved in the shape of a concave lens, whereby a pot-like cap nut or union nut that is screwed over the male thread of the extension of the cap bell can have an inside bottom surface that is curved so that it is opposite to the curvature of the end surface of the extension of the cap bell. Between the end surface of the extension of the cap bell and the inside bottom surface of the cap nut, two plano-convex lenses can be mounted with their flat surfaces in contact with each other. By means of the cap nut described above, the three dimensional joint described above can be fixed in position and thus be made rigid after installation.

In one advantageous configuration of the invention, the piano-convex lens that is in contact with the inside bottom surface of the cap nut can be a component of a nut that holds the fastening screw, as a result of which it is possible to screw the fastening screw more or less deeply into the nut to shorten or lengthen the entire fastening device as necessary. To achieve the above-mentioned three-dimensional articulation, the shank of the nut can be sized so that it runs through a boring in the bottom of the cap nut with some clearance.

An additional three-dimensional articulation can be realized, in the manner of the prior art, in the vicinity of the direct connection of the fastening screw with the holder if the fastening screw runs through a boring in the holder with some clearance and the holder is fastened between a nut and a locknut, whereby, between the nut and the locknut on one hand and the structure on the other hand, there are respective plano-convex lenses with their respective flat surfaces in contact with the structure, and the nut and locknut have contact surfaces that are complementary to the lens. To further explain, one plano-convex lens can be positioned between a nut and a substructure and a second plano-convex lens can be positioned between a locknut and a substructure. In this case, too, it is a question of an adjustable and adaptable three-dimensional articulation during installation that can be made rigid and fixed into position after the installation has been completed, whereby a spacer sleeve can be provided between the three-dimensional articulation that forms the connection to the structure and the three-dimensional articulation that is formed by the cap bell and the cap nut.

The above-discussed embodiments of the present invention will be described further herein below. When the word "invention" is used in this specification, the word "invention" includes "inventions", that is, the plural of "invention". By stating "invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

The invention is explained in greater detail below with reference to the various exemplary embodiments illustrated in the accompanying drawings, in which:

FIGS. 3–12 show details of the inside clamp element, the cap bell, the lens that is in contact with the screw cap of the cap bell set screw, the nut that receives the fastening screw and the cap nut, each shown in perspective and in cross section;

FIG. 3 is a perspective view of the installation element or inside clamp element;

FIG. 4 is a cross-sectional view of the inside clamp element;

FIG. 5 is a perspective view of the cap bell;

FIG. 6 is a cross-sectional view of the cap bell;

FIG. 7 is a perspective view of the lens or lens-shaped member that is in contact with the screw cap of the cap bell set screw;

FIG. 8 is a lateral view of the lens or lens-shaped member that is in contact with the screw cap of the cap bell set screw;

FIG. 9 is a perspective view of the nut that receives the fastening screw;

FIG. 10 is cross-sectional view of the nut that receives the fastening screw;

FIG. 11 is a perspective view of a cap nut;

FIG. 12 is a cross-sectional view of a cap nut;

DESCRIPTION OF THE PREFERRED EMBODIMENT

Figure 1:
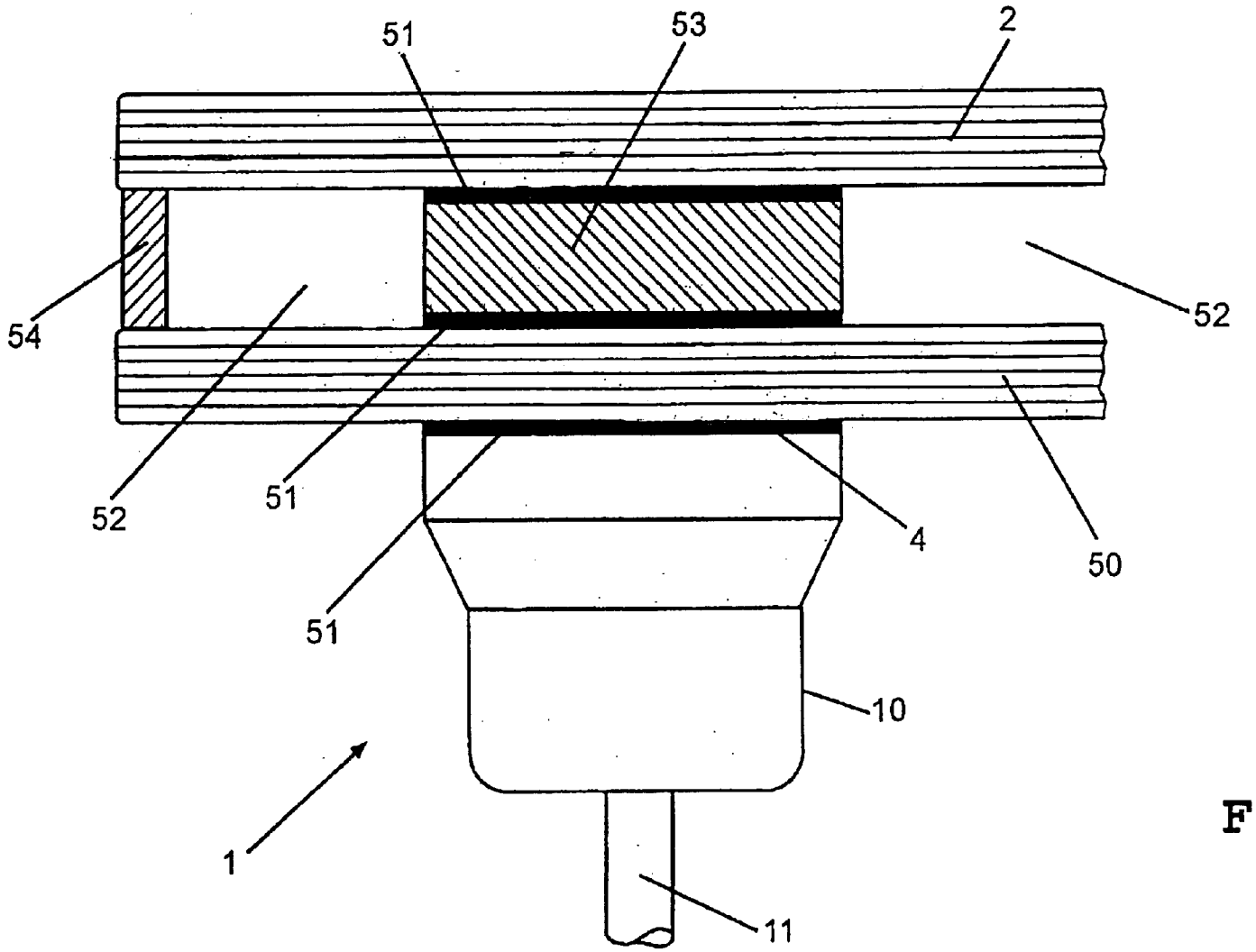
FIG. 1 is a cross section through an insulating glass plate with punctiform holder.

A punctiform holder 1 as shown in FIG. 1 has a mounting element 5 with a flat mounting surface 4 which is glued, using an adhesive, to the insulating glass panel that comprises at least two individual glass plates 2, 50. The glass plates 2, 50 are separated on their surrounding edge in the conventional manner by a spacer 54, so that, between the glass plates 2, 50 there is an air gap 52. This air gap 52 can be filled with a gas. The glass plates 2, 50 can be manufactured in the form of single-pane safety glass or as laminated glass such as safety glass. In FIG. 1, the punctiform holder 1 is detachably or non-detachably connected or attached with the flat mounting surface 4 to an outside surface of the glass plate 50 using an adhesive 51.

In the vicinity of the punctiform holder 1, a spacer piece 53 between the glass plates 2, 50 is also detachably or non-detachably connected with the glass plates 2, 50 using an adhesive 51. Thus there can be a direct transmission of force from the glass plates 2, 50 to the punctiform holder 1. As is clear in the exemplary embodiment illustrated in FIG. 1, with such a fastening of a punctiform holder 1 to the glass plates 2, 50 using adhesive, there is no need to machine the glass, i.e. there is no need to introduce borings and to seal these borings with respect to the air gap 52 between the insulating glass plates 2, 50. This type of holder essentially enormously simplifies and lowers the cost of manufacturing such insulating glass panels. The adhesive used is thereby UV-stable and is preferably transparent. The spacer piece 53 used can thereby be made of glass or metal.

Figure 1A:
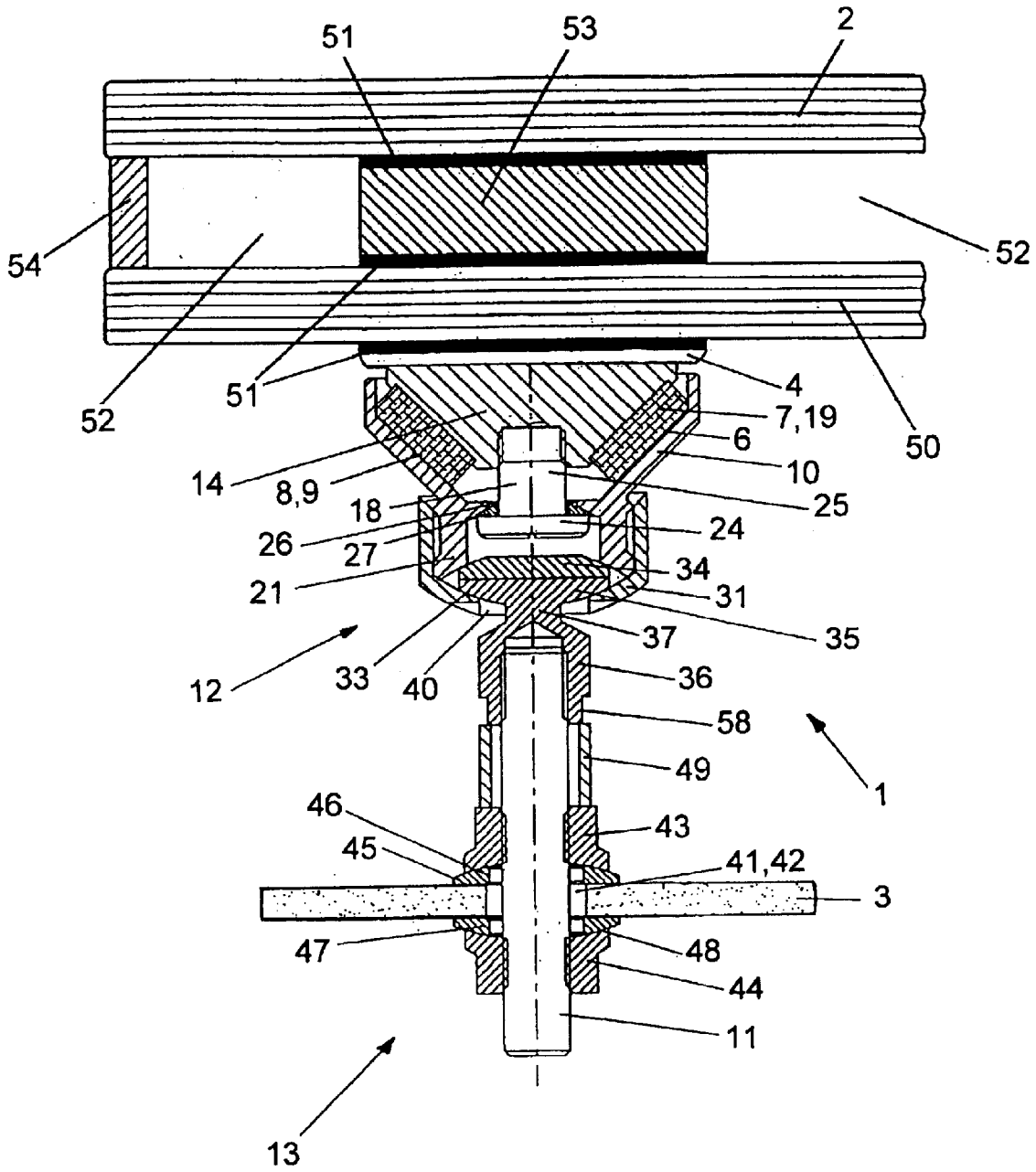
FIG. 1A is a cross section through a fastening device.
Figure 2:
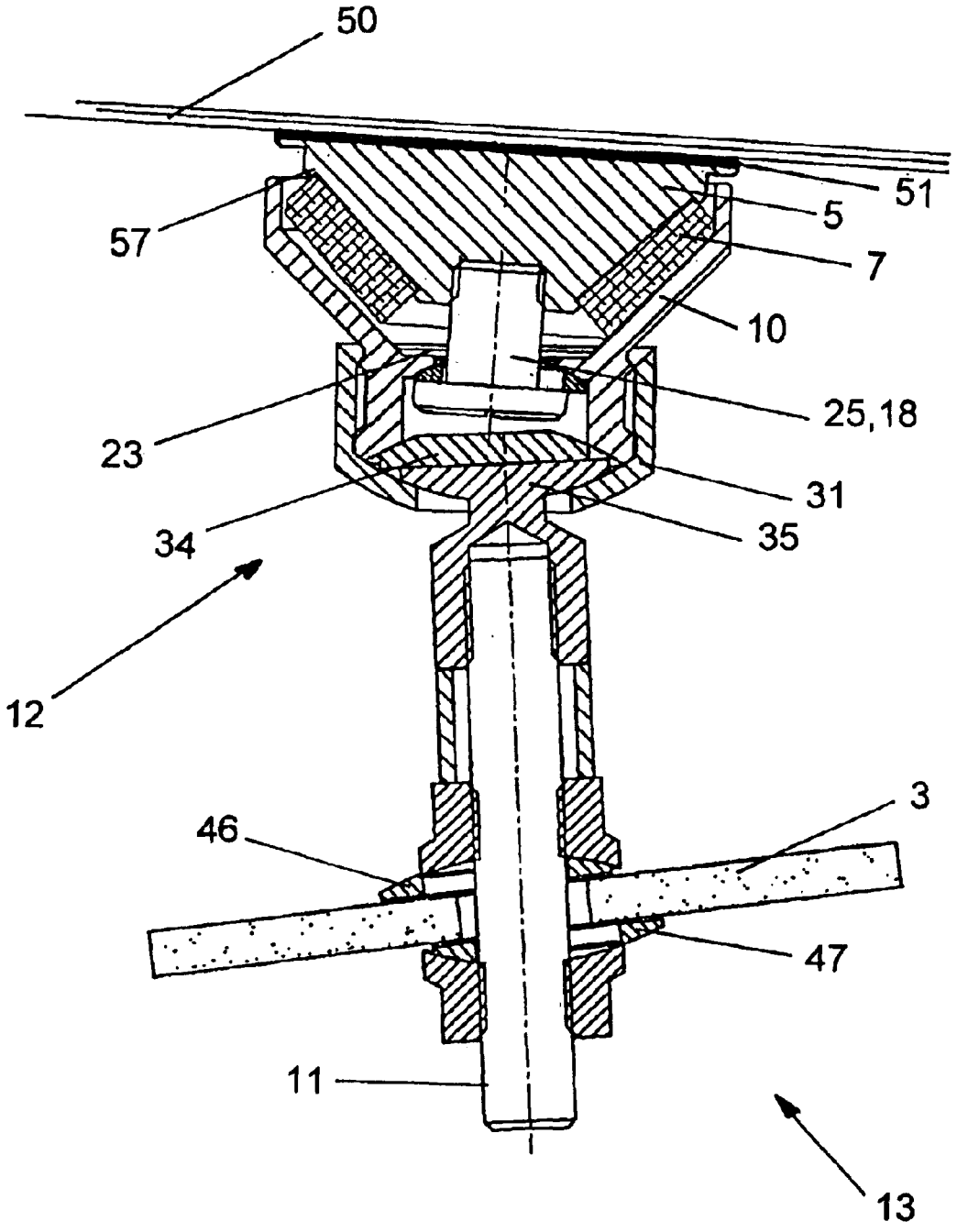
FIG. 2 is a cross section as in FIG. 1A with an insulating glass plate at an angle with respect to the substructure.
Figure 5:
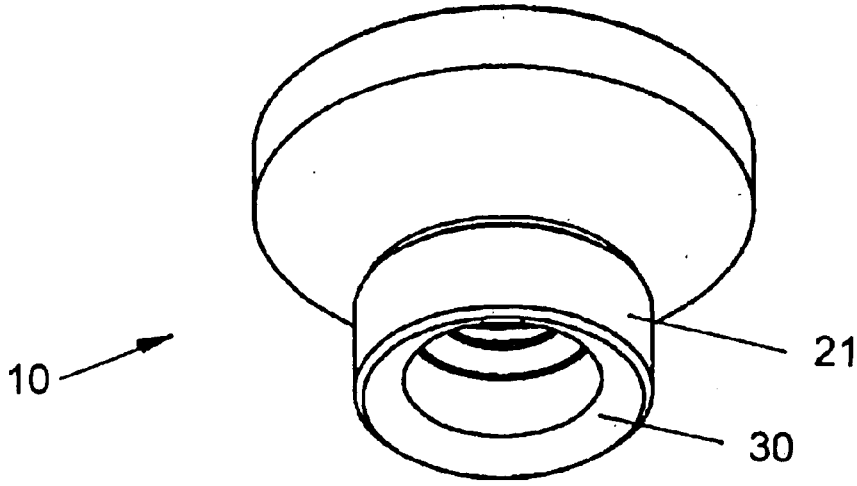
Figure 6:
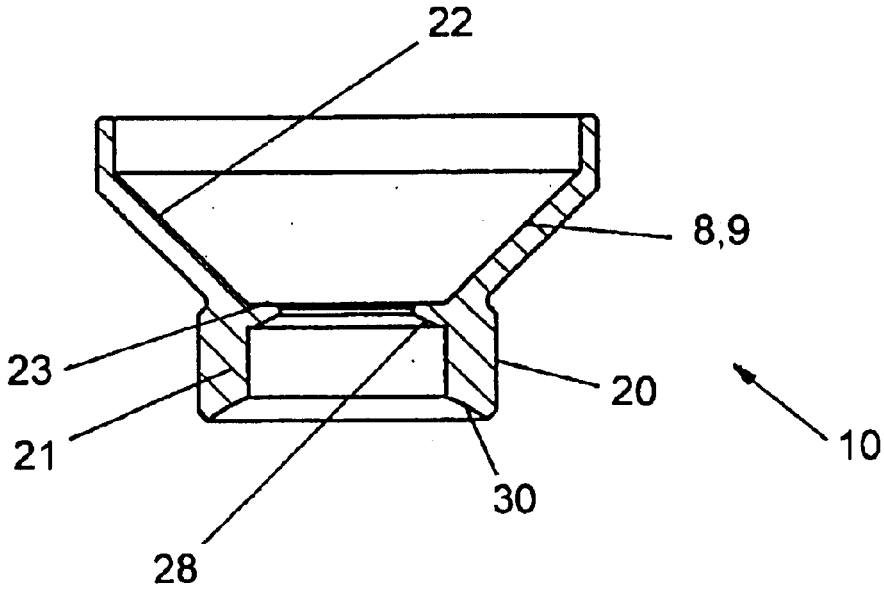
Figure 11:
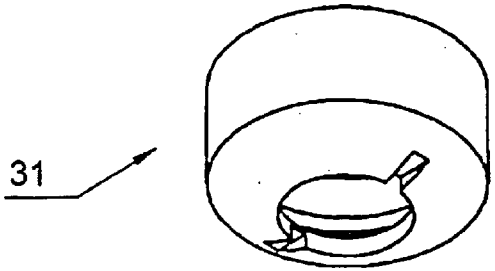
Figure 12:
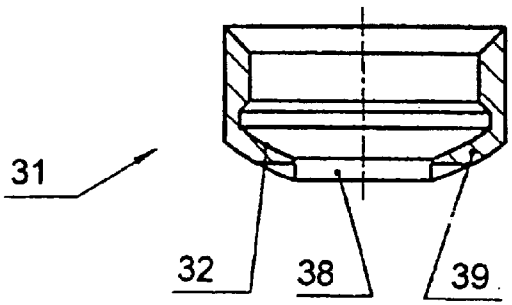
Figure 9:
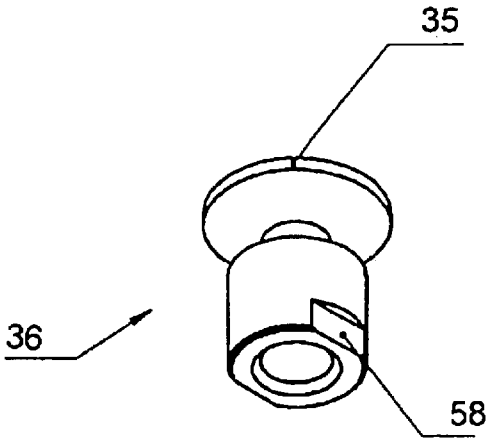
Figure 10:
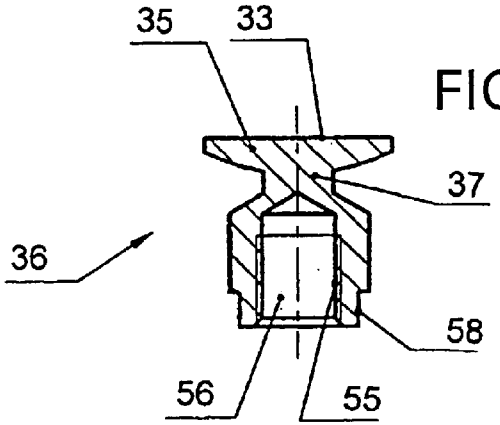
Figure 7:
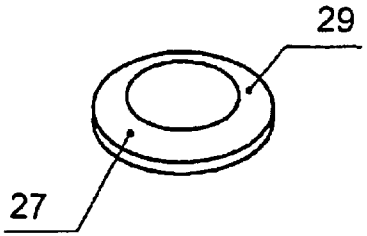
Figure 8:
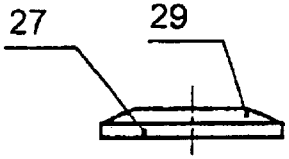

In the exemplary embodiment illustrated by FIG. 1A, the mounting or installation element 5 has a conical shell surface 14 facing away from the flat mounting surface 4, against which conical shell surface 14 a permanently elastic spring element 7 that is realized in the form of a permanently elastic pad 19 supported on a projection 57 (shown in FIG. 2), which spring element practically forms the actual shell surface 6 of the mounting element 5, is in contact. In contact with this shell surface 6 is an inner shell 9 of a cap bell or coupling bell 10 with a complementary surface 8. A blind hole 16 (See FIGS. 3 and 4) of the mounting element 5 connects the mounting element 5 with a three-dimensional articulation 12 (shown in FIGS. 1A and 2). For this purpose, the blind hole 16 has an internal or female thread 15. Engaged in the internal thread 15 is a cap bell set screw 18, the screw head 24 of which is supported on a flange 23 of a cylindrical extension 21 of the cap bell or coupling bell 10 (refer to FIGS. 5 and 6). Between the flange 23 and the screw head 24 there is a preferably elastic lens 27 (refer to FIGS. 7 & 8), which is supported on a contact surface 28 of the flange 23 (shown in FIG. 6), so that, at this point, a three-dimensional articulation (12) is formed in the context of the clearance 26, as shown in FIG. 2. For this purpose, the lens 27 has a complementary surface 29 (see FIGS. 6 through 8). FIG. 6 shows the cylindrical extension 21 of the cap bell 10 that in the vicinity of the base 22 has an end surface 30 that is directed toward a substructure 3 (shown in FIG. 2), whereby the end surface 30 has a concave curvature. As FIG. 12 shows, an inner bottom surface 32 of a cap nut or union nut 31 has a correspondingly opposite curvature, so that two lenses 34 and 35, the flat surfaces 33 of which are in contact with each other, can be located between the end surface 30 of the extension 21 and a base 39 of the cap nut or union nut 31 (refer to FIG. 2). The lens 34 is movable and is in contact with its convex surface against the end surface 30 of the extension 21 (shown in FIG. 5), while the second lens 35, as illustrated in FIGS. 9 and 10, is a fixed component of a nut 36 that holds a fastening screw or attachment bolt 11 (shown in FIGS. 1A and 2), and is supported with its convex surface on the base 39. The nut 36 has a shank 37 (refer to FIGS. 9 and 10) that runs through a boring 38 in the cap nut 31, as shown in FIGS. 11 and 12, with clearance 40 (shown in FIG. 1A).

FIG. 1A shows that when the cap nut 31 is screwed onto the cap bell 10 by means of a male thread 20 (shown in FIG. 6) in the vicinity of the extension 21, the three-dimensional articulation, which is designated 12 in general and is formed by the two lenses 34 and 35 (refer to FIG. 2), can be fixed in position. The nut 36 (See FIGS. 9 and 10) has a blind hole 56 with an internal or female thread 55, into which the fastening screw 11 can be screwed, whereby in the outside cylindrical surface of the nut 36 there are flats 58 for the use of a wrench. FIG. 1A also shows that in the exemplary embodiment, adjacent to the nut 36 there is a spacer sleeve 49, which for its part is supported against a nut 43 that clamps the substructure 3. Between the nut 43 and a locknut 44 there are lenses 46 and 47 which are in contact with complementary contact surfaces 48 of the nut 43 and the locknut 44. Flat surfaces 45 of the lenses 46 and 47 lie in direct contact with the substructure 3.

Because a fastening screw 11 runs through a boring 41 in the substructure 3 with clearance 42, here again, a three-dimensional articulation designated 13 is formed, by means of which construction tolerances can be compensated.

FIG. 2 shows the possible angular position of an insulating glass panel comprising the separated glass plates 2, 50 with respect to the substructure 3 with a corresponding setting of the three-dimensional articulations 12 and 13, as well as a corresponding angled position in the vicinity of a shank 25 of the cap bell set screw 18 with respect to the cap bell 10 on one hand and with respect to the cap nut 31 on the other hand. It is apparent that a displacement of the cap bell 10 with respect to a permanently elastic spring element 7 has taken place. In other words, at this point a three-dimensional articulation has been formed that cannot be permanently fixed in position. The permanently elastic spring element 7 has not changed its position relative to the mounting element 5 as a result of the support on the projections 57.

Figure 13:
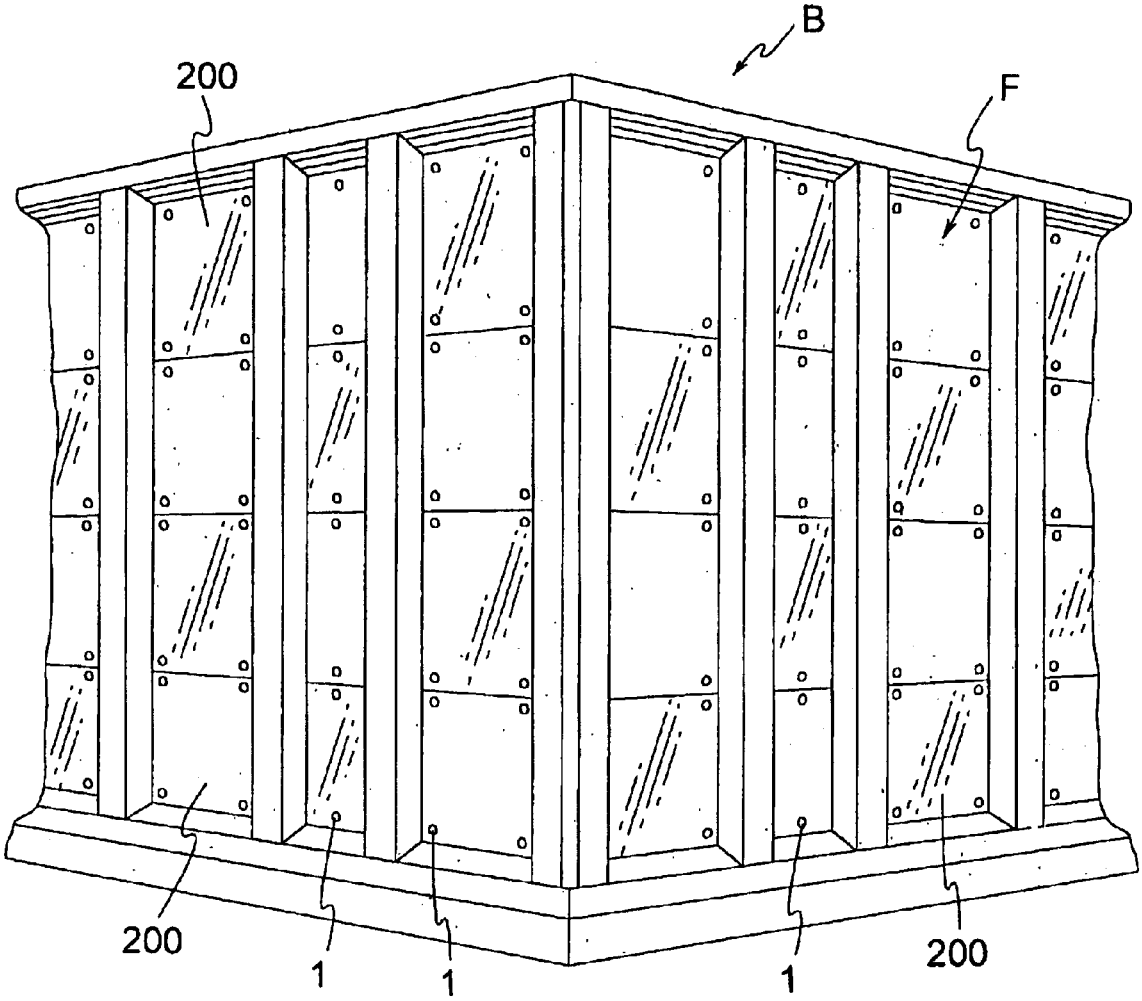
FIG. 13 shows a perspective view of a building with a glass facade.

FIG. 13 shows a perspective view of a building B with a glass facade F composed of glass panels 200 and indicates the attachment of a punctiform holder 1.

Figure 14:
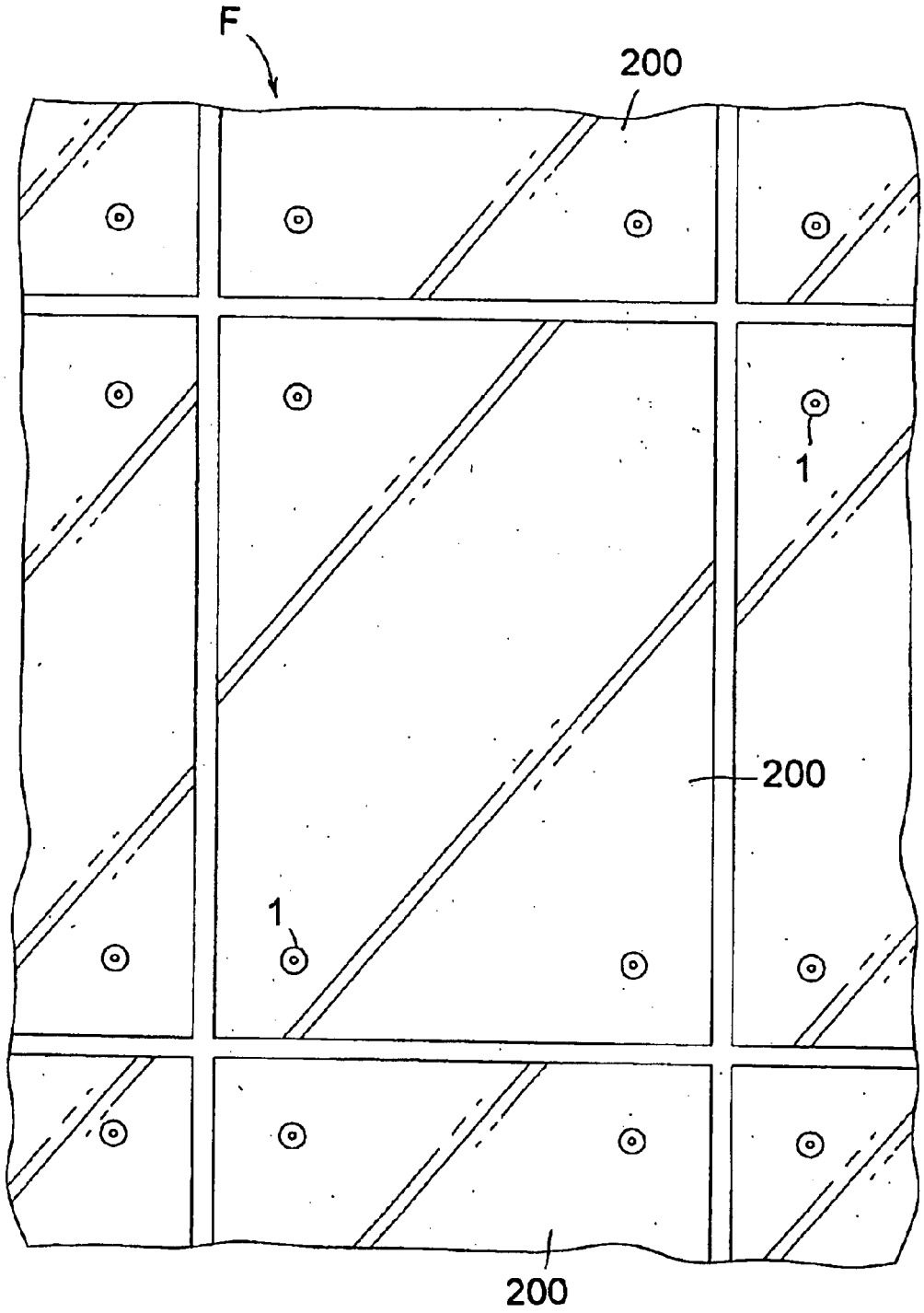
FIG. 14 shows an elevation of part of a building face or facade with glass panels.

FIG. 14 shows an elevation of part of a building facade F with glass panels 200 and indicates where a punctiform holder 1 would attach to the glass panel 200.

The fastening device described above can therefore be used to retain the elasticity of the glass plates 2, 50 because it does not restrict their freedom of movement and thus leads to a neutralization of forces. The fastening device claimed by the invention makes possible an adaptation to environmental constraints and does not lead to the rigidity of the construction material glass, which would necessarily lead to the destruction of the glass, as is the case in the prior art described above.

One feature of the invention resides broadly in a punctiform holder to connect insulating glass panels with at least two glass plates separated by an air gap that is preferably filled with a gaseous medium, and whereby the punctiform holder is also detachably or non-detachably connected to a substructure, characterized by the fact that the punctiform holder has a mounting element with a flat mounting surface which is detachably or non-detachably connected with an outside surface of the glass plates by adhesive, and in the air gap, in the vicinity of the punctiform holder, a spacer piece between the glass plates is also detachably or non-detachably connected with the glass plates by an adhesive.

Another feature of the invention resides broadly in a punctiform holder characterized by the fact that the spacer piece is made of glass.

Yet another feature of the invention resides broadly in a punctiform holder characterized by the fact that the spacer piece is made of metal.

Still another feature of the invention resides broadly in a punctiform holder characterized by the fact that the adhesive is UVstable and transparent.

A further feature of the invention resides broadly in a punctiform holder characterized by the fact that the punctiform holder includes a mounting of the glass plates on a substructure, which mounting is free of bending moments.

Another feature of the invention resides broadly in a punctiform holder characterized by the fact that the mounting that is free of bending moments comprises the mounting element, and that on the shell surface facing away from the mounting surface, the mounting has a conical or crown-shaped surface (shell surface) formed by a permanently elastic spring element, against which a complementary surface of an inner shell of a cap bell can be placed with adjustable bias, and that a three-dimensional articulation that can be made rigid or fixed into position is located between the cap bell and a fastening screw and the substructure respectively.

Yet another feature of the invention resides broadly in a punctiform holder characterized by the fact that the mounting element, on a surface shell facing away from the mounting surface, has a conical or crown-shaped surface.

Still another feature of the invention resides broadly in a punctiform holder characterized by the fact that the mounting element has a central blind hole with an internal or female thread to receive a cap bell set screw that connects the cap bell with the mounting element.

A further feature of the invention resides broadly in a punctiform holder characterized. by the fact that there is a permanently elastic pad between the conical or crown-shaped surface of the mounting element and a complementary surface of the cap bell.

Another feature of the invention resides broadly in a punctiform holder characterized by the fact that the cap bell, on its side facing the substructure, has a cylindrical extension that is provided with an external thread, between which and the cap bell, in the vicinity of a bottom of the cap bell, there is an inwardly directed flange to support the screw head of the cap bell set screw.

Yet another feature of the invention resides broadly in a fastening device characterized by the fact that there is a clearance between the flange and a shank of the cap bell set screw.

Still another feature of the invention resides broadly in a fastening device characterized by the fact that there is a washer or lens between the flange and the screw head of the cap bell set screw.

A further feature of the invention resides broadly in a fastening device characterized by the fact that a contact surface of the flange and a complementary surface of the washer or lens have a conical or crown shape.

Another feature of the invention resides broadly in a fastening device characterized by the fact that an end surface of the extension of the cap bell, which end surface points toward the substructure, has a concave lens-shaped curvature.

Yet another feature of the invention resides broadly in a fastening device characterized by a cup-shaped cap nut that covers the external thread of the extension of the cap bell, whereby the inner bottom surface of the cap nut is curved in the opposite direction to the end surface of the extension of the cap bell.

Still another feature of the invention resides broadly in a fastening device characterized by the fact that between the end surface of the extension of the cap bell and the bottom surface of the cap nut, there are two plano-convex lenses that are in contact with each other via their plane surfaces.

A further feature of the invention resides broadly in a fastening device characterized by the fact that the piano-convex lens that is in contact with the bottom surface of the cap nut is a component of a nut that receives the fastening screw.

Another feature of the invention resides broadly in a fastening device characterized by the fact that a shank of the nut runs through a boring in the bottom of the cap nut with clearance.

Yet another feature of the invention resides broadly in a fastening device characterized by the fact that the fastening screw runs through a boring with clearance and the substructure is fixed in position between a nut and a locknut, whereby between the nut and the locknut on the one hand and between the nut and the substructure on the other hand, there are respective piano-convex lenses that are in contact with their plane surfaces with the holder, and the nut and locknut have contact surfaces that are complementary to the contact surfaces of the lenses.

Still another feature of the invention resides broadly in a fastening device characterized by the fact that there is a spacer sleeve between the nut that receives the fastening screw and the nut that fixes the substructure in position.

A further feature of the invention resides broadly in a fastening device characterized by the fact that the mounting, free of bending moments, comprises a construction of a sphere that is surrounded, in whole or in part, by complementary surfaces, and the bias of which is adjustable.

Another feature of the invention resides broadly in a fastening device characterized by the fact that at least one of the separated glass plates comprises a single-pane or multiple-pane safety glass panel.

The components disclosed in the various publications, disclosed or incorporated by reference herein, may be used in the embodiments of the present invention, as well as equivalents thereof.

The appended drawings in their entirety, including all dimensions, proportions and/or shapes in at least one embodiment of the invention, are accurate and are hereby included by reference into this specification.

All, or substantially all, of the components and methods of the various embodiments may be used with at least one embodiment or all of the embodiments, if more than one embodiment is described herein.

The following U.S. patents are hereby incorporated by reference as if set forth in their entirety herein: U.S. Pat. No. 6,131,346, having inventor KORDES, issued on Oct. 17, 2000; U.S. Pat. No. 6,158,177, having inventor BLÖBAUM, issued on Dec. 12, 2000; U.S. patent application Ser. No. 09/731,265, having inventors BLÖBAUM and JANUTTA, filed on Dec. 6, 2000; and U.S. patent application Ser. No. 09/498,385, having inventor ELMER, filed on Feb. 3, 2000.

Some examples of glass facade structures and/or mounting devices for facade structures that may be utilized or adapted for use in at least one possible embodiment of the present invention may be found in the following foreign patents: German Patent No. 197 40 878, having inventor KORDES, issued on Sep. 17, 1997; German Patent No. 197 13 038.0, having inventor BLÖBAUM, issued on Mar. 27, 1997; German Patent No. 199 15 478.3, having inventors BLÖBAUM and JANUTTA, issued on Apr. 7, 1999; German Patent No. 199 15 193.8, having inventor ELMER, issued on Apr. 6, 1999; Federal Republic of Germany Patent No. 296 02 315 U, issued to ARNOLD GLASWERKE on Jul. 3, 1997; and European Patent No. 0 707 153 A, issued to OCTATUBE SPACE STRUCTURES on Apr. 17, 1996.

The corresponding foreign and international patent publication applications, namely, Federal Republic of Germany Patent Application No. 199 39 172.6, filed on Aug. 20, 1999, having inventor Lothar GINZEL, and DE-OS 199 39 172.6 and DE-PS 199 39 172.6, and International Application No. PCT/EP00/08080, filed on Aug. 18, 2000, having inventor Lothar GINZEL, are listed to provide additional background information.

The following U.S. Patent Application is to be incorporated by reference as follows: U.S. patent application Ser. No. 09/854,411, entitled, "A Glass Display Case Being Held Together by Clamping Fittings and a Clamping Fitting for the Corner Connection of Three Adjoining Walls, Especially Glass Panes," having attorney docket No. NHL-DOR-91 US, and inventor Hubert ELMER, claiming priority from Federal Republic of Germany Application No. 199 43 565.0, filed on Sep. 13, 1999, and International Application No. PCT/EP00/08066, filed on Aug. 18, 2000.

The following U.S. Patent is to be incorporated by reference as follows: U.S. Pat. No. 6,467,227, having attorney docket No. NHL-DOR-94 US, and inventor Hubert ELMER, claiming priority from Federal Republic of Germany Application No. 199 45 197.4, filed on Sep. 21, 1999, and International Application No. PCT/EP00/09165, filed on Sep. 19, 2000.

The following U.S. Patent is to be incorporated by reference as follows: U.S. Pat. No. 6,412,242, having attorney docket No. NHL-DOR-96 US, and inventor Hubert ELMER, claiming priority from Federal Republic of Germany Application No. 199 45 196.6, filed on Sep. 21, 1999, and International Application No. PCT/EP00/09164, filed on Sep. 19, 2000.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents but also equivalent structures.

Some examples of glass facade structures and/or mounting devices for facade structures that may be utilized or adapted for use in at least one possible embodiment of the present invention may be found in the following U.S. Pat. No. 5,212,922, having inventor Werner, issued on May 25, 1993; U.S. Pat. No. 4,905,435, having inventor Horst, issued on Mar. 6, 1990; U.S. Pat. No. 5,791,105, having inventor Gangi, issued on Aug. 11, 1998; U.S. Pat. No. 5,493,831, having inventor Jansson, issued on Feb. 27, 1996; U.S. Pat. No. 5,301,484, having inventor Jansson, issued on Apr. 12, 1994; U.S. Pat. No. 5,524,404, having inventor Lahaye, issued on Jun. 11, 1996; U.S. Pat. No. 4,793,112, having inventor Süfke, issued on Dec. 27, 1988, and U.S. Pat. No. 4,837,996, having inventor Eckelt, issued on Jun. 13, 1989. The aforementioned patents are hereby incorporated by reference as if set forth in their entirety herein.

Some examples of safety glass that may be utilized or adapted for use in at least one possible embodiment of the present invention may be found in the following U.S. Pat. No. 5,853,835, having inventor Leniton, issued on Dec. 29, 1998; U.S. Pat. No. 5,049,433, having inventor Leotta, issued on Sep. 17, 1991; U.S. Pat. No. 5,002,820, having inventors Bolton et al., issued on Mar. 26, 1991; U.S. Pat. No. 4,668,574, having inventors Bolton et al., issued on May 26, 1987; U.S. Pat. No. 4,663,228, having inventors Bolton et al., issued on May 5, 1987; U.S. Pat. No. 4,632,877, having inventors Watanabe et al., issued on Dec. 30, 1986; U.S. Pat. No. 4,600,653, having inventors Washita et al., issued on Jul. 15, 1986; U.S. Pat. No. 4,584,245, having inventors Kuga et al., issued on Apr. 22, 1986; U.S. Pat. No. 4,551,372, having inventor Kunert, issued on Nov. 5, 1985; U.S. Pat. No. 4,382,996, having inventors Mori et al., issued on May 10, 1983; U.S. Pat. No. 4,309,484, having inventors Ohmae et al., issued on Jan. 5, 1982; and U.S. Pat. No. 4,039,719, having inventors Matsuda et al., issued on Aug. 2, 1977. The aforementioned patents are hereby incorporated by reference as if set forth in their entirety herein.

Some examples of UV-stable adhesives for glass that may be utilized or adapted for use in at least one possible embodiment of the present invention may be found in the following U.S. Pat. No. 6,201,055 B1, having inventors Lutz et al., issued on Mar. 13, 2001; and U.S. Pat. No. 6,191,199 B1, having inventors Renz et al., issued on Feb. 20, 2001.

The aforementioned patents are hereby incorporated by reference as if set forth in their entirety herein.

Some examples of other adhesives for glass that may be utilized or adapted for use in at least one possible embodiment of the present invention may be found in the following U.S. Pat. No. 5,102,937, having inventors Warren et al., issued on Apr. 7, 1992; and U.S. Pat. No. 5,075,382, having inventors Ohmae et al., issued on Dec. 24, 1991. The aforementioned patents are hereby incorporated by reference as if set forth in their entirety herein.

Some examples of insulated or insulating glass that may be utilized or adapted for use in at least one possible embodiment of the present invention may be found in the following U.S. Pat. No. 6,138,433, having inventor Ridge, issued on Oct. 31, 2000; U.S. Pat. No. 6,059,909, having inventors Hartig et al., issued on May 9, 2000; U.S. Pat. No. 6,038,825, having inventors Shah et al.; U.S. Pat. No. 6,014,872, having inventors Hartig et al., issued on Jan. 18, 2000; U.S. Pat. No. 5,763,338, having inventors Asada et al., issued on Jun. 9, 1998; U.S. Pat. No. 5,705,010, having inventor Larsen, issued on Jan. 6, 1998; U.S. Pat. No. , 5,683,764, having inventor Alts, issued on Nov. 4, 1997; U.S. Pat. No. 5,679,419, having inventor Larsen, issue on Oct. 21, 1997; U.S. Pat. No. 5,377,473, having inventors Narayan et al., issued on Jan. 3, 1995; U.S. Pat. No. 5,313,761, having inventor Leopold, issued on May 24, 1994; and U.S. Pat. No. 5,270,084, having inventor Parker, issued on Dec. 14, 1993.

Some examples of insulating gases, insulated glass panes filled with an insulating gas other than air, and methods of filling glass panes with insulating gas that may be utilized or adapted for use in at least one possible embodiment of the present invention may be found in the following U.S. Pat. No. 5,957,169, having inventor Trpkovski, issued on Sep. 28, 1999; U.S. Pat. No. 5,762,739, having inventors Lenhardt et al., issued on Jun. 9, 1998; U.S. Pat. No. 5,704,405, having inventor Lisec, issued on Jan. 6, 1998; U.S. Pat. No. 5,676,782, having inventor Lisec, issued on Oct. 14, 1997; U.S. Pat. No. 5,645,678, having inventor Lisec, issued on Jul. 8, 1997; U.S. Pat. No. 5,626,712, having inventor Lisec, issued on May 6, 1997; U.S. Pat. No. 5,413,156, having inventor Lisec, issued on May 9, 1995; U.S. Pat. No. 5,336,574, having inventors Lenhardt et al., issued on Nov. 22, 1994; U.S. Pat. No. 5,350,469, having inventors Lendhardt et al., issued on Sep. 27, 1994; U.S. Pat. No. 5,110,337, having inventor Lisec, issued on May 5, 1992; U.S. Pat. No. 4,921,022, having inventor Lisec, issued on May 1, 1990; U.S. Pat. No. 4,886,095, having inventor Lisec, issued on Dec. 12, 1989; and U.S. Pat. No. 4,369,084, having inventor Lisec, issued on Jan. 18, 1983. The aforementioned patents are hereby incorporated by reference as if set forth in their entirety herein.

The invention as described herein above in the context of the preferred embodiments is not to be taken as limited to all of the provided details thereof, since modifications and variations thereof may be made without departing from the spirit and scope of the invention.

What is claimed is:

1. An attachment device for mounting a glass panel to a structure, comprising:

a first attachment element configured to attach a first surface of a first glass pane to a first surface of a second glass pane;

said first attachment element being configured to space the first glass pane from the second glass pane upon installation of said attachment device;

a second attachment element having a first surface configured to attach to a second surface of the second glass pane and configured to be disposed opposite to said first attachment element on the first surface of the second glass pane;

an adhesive being configured to attach said first attachment element and said second attachment element to glass;

said first attachment element having a first surface and a second surface disposed opposite said first surface;

said first surface of said first attachment element being configured to receive said adhesive to permit said adhesive to attach said first attachment element to a first surface of the first glass pane;

said second surface of said first attachment element being configured to receive said adhesive to permit said adhesive to attach said first attachment element to a first surface of the second glass pane;

said first surface of said second attachment element being configured to receive said adhesive to permit said adhesive to attach said second attachment element to said second surface of said second glass pane;

said second attachment element having a second surface opposite to said first surface;

a conical elastic spring member having an inside surface and an outside surface;

said conical elastic spring member being disposed against said second surface of said second attachment element thus to dispose said outside surface of said conical elastic spring member away from said second attachment element;

a coupling bell having an inner surface;

said inner surface of said coupling bell being disposed adjacent to said outer surface of said conical elastic spring member;

a fastening screw having a first end portion and a second end portion;

said fastening screw being configured to attach said attachment device to a structure;

a first stiffenable articulation being configured to connect said second end portion of said fastening screw to a structure; and a second stiffenable articulation connecting said first end portion of said fastening screw to said coupling bell.

2. The attachment device according to claim 1, wherein:

said first attachment element comprises one of:

glass; or metal.

3. The attachment device according to claim 2, wherein:

said second surface of said second attachment element has a conical or crown shape;

said conical- or crown-shaped surface of said second attachment element and said inner surface of said coupling bell are configured to provide an adjustable bias; and both said first stiffenable articulation and said second stiffenable articulation are configured to be fixably positioned.

4. The attachment device according to claim 3, wherein said conical elastic spring member of said attachment device comprises an elastic cushion.

5. The attachment device according to claim 4, wherein:

said second attachment element has a centrally disposed hole;

said centrally disposed hole has an internal or female thread;

said coupling bell of said attachment device comprises a cylindrical extension opposite to said inner surface of said coupling bell;

said cylindrical extension has an external or male thread;

a coupling bell regulating screw is configured to attach said second attachment element to said coupling bell;

said coupling bell regulating screw comprises a threaded portion, a shank, and a screw head;

said threaded portion of said coupling bell regulating screw engages said internally threaded hole in said second attachment element, thereby connecting said coupling bell to said second attachment element;

said coupling bell comprises a flange disposed adjacent to said cylindrical extension;

said flange supports said screw head of said coupling bell regulating screw, permitting a clearance between said flange and said shank of said coupling bell regulating screw;

said cylindrical extension of said coupling bell comprises an end portion opposite to said flange of said coupling bell;

said end portion of said cylindrical extension comprises a concave lens-shaped curvature;

said end portion of said cylindrical extension is disposed toward a structure;

a washer or lens is disposed between said flange of said coupling bell and said coupling bell regulating screw;

said flange of said coupling bell comprises a contact surface;

said washer or lens comprises a surface complementary to said contact surface of said flange;

both said contact surface of said flange and said complementary surface of said washer or lens comprise a conical or crown shape;

said second stiffenable articulation comprises:

a union nut;

said union nut comprising an inner bottom area;

said inner bottom area of said union nut comprising a curved surface;

said curved surface of said union nut having a curvature opposite to said concave curvature of said end portion of said cylindrical extension;

a first planoconvex lens having a first side which is substantially flat and a second side which is substantially convex;

said first planoconvex lens being disposed between said bottom area of said union nut and said end portion of said cylindrical extension of said coupling bell;

a nut configured to receive said fastening screw;

said nut configured to receive said fastening screw comprising a first end portion and a second end portion;

said first end portion of said nut configured to receive said fastening screw comprising a second planoconvex lens;

said second planoconvex lens having a first side which is substantially flat and a second side which is substantially convex;

said first side of said second planoconvex lens being disposed against said first side of said first planoconvex lens;

said second end portion of said nut configured to receive said fastening screw being configured to receive said first end portion of said fastening screw;

said nut configured to receive said fastening screw comprises a shaft;

said bottom area of said union nut has a hole;

said shaft of said nut configured to receive said fastening screw extends through said hole in said bottom of said union nut with play to connect said first end portion of said fastening screw to said coupling bell;

said first stiffenable articulation comprises:

a third planoconvex lens having a first side that is substantially flat and a second side that is substantially convex;

said third planoconvex lens having a hole configured to slidably engage said second end portion of said fastening screw;

a fourth planoconvex lens having a first side that is substantially flat and a second side that is substantially convex;

said fourth planoconvex lens having a hole configured to slidably engage said second end portion of said fastening screw;

said third planoconvex lens and said fourth planoconvex lens being slidably disposed on said second end portion of said fastening screw to thus dispose said first side of said third planoconvex lens and said first side of said fourth planoconvex lens on opposite sides of a structure;

a first mounting nut comprising a concave surface;

a second mounting nut comprising a concave surface;

said concave surface of said first mounting nut being disposed to said second side of said third planoconvex lens;

said concave surface of said second mounting nut being disposed to said second side of said fourth planoconvex lens;

said first mounting nut and said second mounting nut are configured to attach to a structure; and a spacer sleeve is disposed between said nut configured to receive said fastening screw and said first mounting nut.

6. The attachment device according to claim 5, wherein said adhesive is configured to be UV-stable and transparent.

7. The attachment device according to claim 6, wherein at least one of said glass panes comprises a single-pane or a multiple-pane safety glass panel.

8. A facade on a structure, said facade comprising:

a first glass pane having a first side and a second side;

a second glass pane having a first side and a second side;

an attachment device for mounting said first glass pane and said second glass pane to a structure; said attachment device comprising:

a first attachment element being configured to space said first glass pane from said second glass pane;

said first attachment element attaching said first side of said first glass pane to said first side of said second glass pane, said first attachment element spacing said first glass pane apart from said second glass pane and thus forming a gap between said first glass pane and said second glass pane to separate said first glass pane and said second glass pane from one another;

a second attachment element having a first surface attached to said second side of said second glass pane and said second attachment element being disposed opposite to said first attachment element on the first side of the second glass pane;

an adhesive configured to attach said first attachment element and said second attachment element to glass;

said first attachment element having a first surface and a second surface disposed opposite said first surface;

said first surface of said first attachment element being configured to receive said adhesive;

said adhesive attaching said first side of said first glass pane to said first surface of said first attachment element;

said second surface of said first attachment element being configured to receive said adhesive;

said adhesive attaching said first side of said second glass pane to said second surface of said first attachment element;

said first surface of said second attachment element being configured to receive said adhesive;

said adhesive attaching said first surface of said second attachment element to said second side of said second glass pane;

said second attachment element having a second surface opposite to said first surface of said second attachment element;

a first stiffening articulation arrangement operatively connecting said second attachment element to the structure;

said first stiffening articulation arrangement being configured to compensate for irregularities of flatness in the structure and to maintain said facade substantially flat;

said attachment device being configured to provide sufficient elasticity to compensate for wind pressure and thermal stress on said facade;

said first attachment element comprises at least one of:

glass; or metal;

said attachment device further comprises:

a conical elastic spring member having an inside surface and an outside surface;

said conical elastic spring member being disposed against said second surface of said second attachment element thus to dispose said outside surface of said conical elastic spring member away from said second attachment element;

a coupling bell having an inner surface;

said inner surface of said coupling bell being disposed adjacent to said outer surface of said conical elastic spring member;

an fastening screw having a first end portion and a second end portion; and said fastening screw being configured to attach said attachment device to a structure.

9. The facade on a structure according to claim 8, wherein:

said second surface of said second attachment element has a conical or crown shape;

said conical- or crown-shaped second surface of said second attachment element and said inner surface of said coupling bell are configured to provide an adjustable bias;

said attachment device further comprises:

a second stiffening articulation arrangement; and both said first stiffening articulation arrangement and said second stiffening articulation arrangement are configured to be fixably positioned.

10. The facade on a structure according to claim 9, wherein said conical elastic spring member of said attachment device comprises an elastic cushion.

11. The facade on a structure according to claim 10, wherein:

said second attachment element has a centrally disposed hole;

said centrally disposed hole has an internal or female thread;

said coupling bell of said attachment device comprises a cylindrical extension opposite to said inner surface of said coupling bell;

said cylindrical extension has an external or male thread;

said attachment device further comprises:

a coupling bell regulating screw configured to attach said coupling bell to said second attachment element;

said coupling bell regulating screw comprises a threaded portion, a shank, and a screw head;

said threaded portion of said coupling bell regulating screw engages said internally threaded hole in said second attachment element, thus connecting said coupling bell to said second attachment element;

said coupling bell comprises a flange disposed adjacent to said cylindrical extension;

said flange supports said screw head of said coupling bell regulating screw to permit a clearance between said flange and said shank of said coupling bell regulating screw;

said cylindrical extension of said coupling bell comprises an end portion opposite to said flange of said coupling bell;

said end portion of said cylindrical extension comprises a concave lens-shaped curvature;

said end portion of said cylindrical extension is disposed toward a structure;

a washer or lens disposed between said flange of said coupling bell and said coupling bell regulating screw;

said flange of said coupling bell comprises a contact surface;

said washer or lens comprises a surface complementary to said contact surface of said flange;

both said contact surface of said flange and said complementary surface of said washer or lens comprise a conical or crown shape;

said second stiffening articulation arrangement of said attachment device comprises:

a union nut;

said union nut comprising an inner bottom area;

said inner bottom area of said union nut comprising a curved surface;

said curved surface of said union nut having a curvature opposite to said concave curvature of said end portion of said cylindrical extension;

a first planoconvex lens having a first side which is substantially flat and a second side which is substantially convex;

said first planoconvex lens being disposed between said bottom area of said union nut and said end portion of said cylindrical extension of said coupling bell;

a nut configured to receive said fastening screw;

said nut configured to receive said fastening screw comprising a first end portion and a second end portion;

said first end portion of said nut configured to receive said fastening screw comprising a second planoconvex lens;

said second planoconvex lens having a first side which is substantially flat and a second side which is substantially convex;

said first side of said second planoconvex lens being disposed against said first side of said first planoconvex lens; and said second end portion of said nut configured to receive said fastening screw being configured to receive said first end portion of said fastening screw;

said nut configured to receive said fastening screw comprises a shaft;

said bottom area of said union nut has a hole;

said shaft of said nut configured to receive said fastening screw extends through said hole in said bottom of said union nut with play to connect said first end portion of said fastening screw to said coupling bell;

said first stiffening articulation arrangement of said attachment device comprises:

a third planoconvex lens having a first side that is substantially flat and a second side that is substantially convex;

said third planoconvex lens having a hole configured to slidably engage said second end portion of said fastening screw;

a fourth planoconvex lens having a first side that is substantially flat and a second side that is substantially convex;

said fourth planoconvex lens having a hole configured to slidably engage said second end portion of said fastening screw;

said third planoconvex lens and said fourth planoconvex lens being slidably disposed on said second end portion of said fastening screw to thus dispose said first side of said third planoconvex lens and said first side of said fourth planoconvex lens on opposite sides of a structure;

a first mounting nut having an end comprising a concave surface;

a second mounting nut having an end comprising a concave surface;

said concave surface of said first mounting nut being disposed to said second side of said third planoconvex lens;

said concave surface of said second mounting nut being disposed to said second side of said fourth planoconvex lens; and said first mounting nut and said second mounting nut being configured to attach and being attached to a structure;

a spacer sleeve is disposed between said nut configured to receive said fastening screw and said first mounting nut.

12. A facade on a structure, said facade comprising:

a first glass pane having a first side and a second side;

a second glass pane having a first side and a second side;

an attachment device for mounting said first glass pane and said second glass pane to a structure;

said attachment device comprising:

a first attachment element being configured to space said first glass pane from said second glass pane;

said first attachment element attaching said first side of said first glass pane to said first side of said second glass pane, said first attachment element spacing said first glass pane apart from said second glass pane and thus forming a gap between said first glass pane and said second glass pane to separate said first glass pane and said second glass pane from one another;

a second attachment element having a first surface attached to said second side of said second glass pane and said second attachment element being disposed opposite to said first attachment element on the first side of the second glass pane;

an adhesive configured to attach said first attachment element and said second attachment element to glass;

said first attachment element having a first surface and a second surface disposed opposite said first surface;

said first surface of said first attachment element being configured to receive said adhesive;

said adhesive attaching said first side of said first glass pane to said first surface of said first attachment element;

said second surface of said first attachment element being configured to receive said adhesive;

said adhesive attaching said first side of said second glass pane to said second surface of said first attachment element;

said first surface of said second attachment element being configured to receive said adhesive;

said adhesive attaching said first surface of said second attachment element to said second side of said second glass pane;

said second attachment element having a second surface opposite to said first surface of said second attachment element;

a first stiffening articulation arrangement operatively connecting said second attachment element to the structure;

said first stiffening articulation arrangement being configured to compensate for irregularities of flatness in the structure and to maintain said facade substantially flat;

said attachment device being configured to provide sufficient elasticity to compensate for wind pressure and thermal stress on said facade;

said adhesive is configured to be UV-stable and transparent; and at least one of said glass panes comprises a single-pane or a multiple-pane safety glass panel.

* * * * *

UNITED STATES PATENT AND TRADEMARK OFFICE

CERTIFICATE OF CORRECTION

PATENT NO. : 6,715,955 B2
DATED : April 6, 2004
INVENTOR(S) : Lothar Ginzel

It is certified that error appears in the above-identified patent and that said Letters Patent is hereby corrected as shown below:

Title page,
Item [54], Title, should read:
-- AN ATTACHMENT DEVICE FOR MOUNTING A GLASS PANE FIXEDLY TO A STRUCTURE, SUCH AS A BUILDING AND A FACADE HAVING ATTACHMENT DEVICES FOR MOUNTING GLASS PANES FIXEDLY TO A STRUCTURE, SUCH AS A BUILDING --.

Column 4,
Line 20, before “lens”, delete “piano-convex” and insert -- plano-convex --.

Column 8,
Line 47, after the second occurrence of “the”, delete “piano-” and insert -- plano- --.
Line 62, after “respective”, delete “piano-convex” and insert -- plano-convex --.

Signed and Sealed this

Tenth Day of August, 2004

JON W. DUDAS
*Acting Director of the United States Patent and Trademark Office*